US007514626B1

(12) United States Patent
Snyder

(10) Patent No.: US 7,514,626 B1
(45) Date of Patent: Apr. 7, 2009

(54) METHOD AND APPARATUS FOR ELECTROSTATIC PICKUP FOR STRINGED MUSICAL INSTRUMENTS

(76) Inventor: John Jerome Snyder, 24 Tanglewood La., Basking Ridge, NJ (US) 07929-1219

( * ) Notice: Subject to any disclaimer, the term of this patent is extended or adjusted under 35 U.S.C. 154(b) by 0 days.

(21) Appl. No.: 11/956,339

(22) Filed: Dec. 14, 2007

(51) Int. Cl.
*G10H 3/18* (2006.01)

(52) U.S. Cl. ..... 84/733; 84/723

(58) Field of Classification Search ..... 84/723, 84/725–728, 733
See application file for complete search history.

(56) References Cited

U.S. PATENT DOCUMENTS

| | | | | | |
|---|---|---|---|---|---|
| 1,758,777 | A | | 5/1930 | Barton | |
| 1,785,915 | A | | 12/1930 | Robb | |
| 1,906,985 | A | | 5/1933 | Marrison | |
| 1,915,859 | A | | 6/1933 | Miessner et al. | |
| 1,933,296 | A | * | 10/1933 | Jacobs | 84/735 |
| 1,952,630 | A | | 3/1934 | Palmgren | |
| 1,996,669 | A | | 4/1935 | Bourn | |
| 2,001,708 | A | | 5/1935 | Curtis | |
| 2,015,014 | A | | 9/1935 | Hoschke | |
| 2,018,924 | A | | 10/1935 | Ranger | |
| 2,175,325 | A | | 10/1939 | Sunshine | |
| 2,176,525 | A | | 10/1939 | Firestone | |
| 2,214,764 | A | | 9/1940 | Hammond | |
| 2,222,057 | A | | 11/1940 | Benioff | |
| 2,228,881 | A | * | 1/1941 | Le Clair | 84/733 |
| 2,261,346 | A | | 11/1941 | Demuth | |
| 2,284,911 | A | | 6/1942 | Maas | |
| 2,318,936 | A | | 5/1943 | Fisher | |
| 2,368,842 | A | | 2/1945 | Kealoha | |
| 2,455,575 | A | | 12/1948 | Fender et al. | |
| 2,462,531 | A | | 2/1949 | Minshall | |
| 2,542,611 | A | | 2/1951 | Zuck | |
| 2,573,254 | A | | 10/1951 | Fender | |
| 2,582,441 | A | | 1/1952 | Kunz | |
| 2,623,996 | A | | 12/1952 | Gray | |
| 2,770,995 | A | | 11/1956 | Stibitz | |
| 2,896,491 | A | | 7/1959 | Lover | |
| 2,911,870 | A | | 11/1959 | Bauer | |
| 2,921,494 | A | | 1/1960 | Leslie | |
| 2,952,179 | A | | 9/1960 | Andersen | |
| 2,976,755 | A | * | 3/1961 | Fender | 84/727 |
| 2,986,963 | A | | 6/1961 | Jones | |
| 3,090,274 | A | | 5/1963 | Fender | |
| 3,118,022 | A | | 1/1964 | Sessler et al. | |
| 3,139,476 | A | | 6/1964 | Alvarez | |
| 3,259,683 | A | | 7/1966 | Tomcik | |
| 3,322,875 | A | | 5/1967 | Roll et al. | |
| 3,334,174 | A | | 8/1967 | Shiga et al. | |
| 3,483,303 | A | * | 12/1969 | Warner | 84/728 |

(Continued)

FOREIGN PATENT DOCUMENTS

BE 451466 B1 8/1943

(Continued)

*Primary Examiner*—David S. Warren

(57) ABSTRACT

This invention relates to the method and apparatus for electrostatic pickup of sound from stringed musical instruments to addresses the unique requirements of acoustic stringed musical instruments with a portable, detachable, safe-to-handle, easy-to-use, low-noise, electrostatic pickup that captures the tone of the musical instrument, is usable with common musical sound systems, avoids acoustic feedback problems associated with air microphones in live settings, and is easy to manufacture using current common materials and practices.

5 Claims, 3 Drawing Sheets

U.S. PATENT DOCUMENTS

| | | | | | |
|---|---|---|---|---|---|
| 3,588,311 | A | * | 6/1971 | Zoller | 84/725 |
| 3,621,106 | A | | 11/1971 | Irastorza | |
| 3,675,529 | A | * | 7/1972 | Van Der Woerd | 84/455 |
| 3,748,367 | A | * | 7/1973 | Lamme et al. | 84/679 |
| 4,145,944 | A | * | 3/1979 | Helpinstill, II | 84/726 |
| 4,212,220 | A | * | 7/1980 | Helpinstill, II | 84/726 |
| 4,220,069 | A | | 9/1980 | Fender | |
| 4,230,013 | A | * | 10/1980 | Wellings | 84/733 |
| 4,372,186 | A | * | 2/1983 | Aaroe | 84/725 |
| 4,495,641 | A | | 1/1985 | Vernino | |
| 4,580,481 | A | * | 4/1986 | Schaller et al. | 84/727 |
| 4,654,546 | A | * | 3/1987 | Kirjavainen | 307/400 |
| 4,750,397 | A | * | 6/1988 | Ashworth-Jones | 84/731 |
| 4,837,836 | A | * | 6/1989 | Barcus | 381/118 |
| 4,852,443 | A | * | 8/1989 | Duncan et al. | 84/733 |
| 4,995,293 | A | | 2/1991 | Anderson | |
| 5,430,246 | A | * | 7/1995 | Lace et al. | 84/726 |
| 5,567,903 | A | * | 10/1996 | Coopersmith et al. | 84/723 |
| 5,949,014 | A | * | 9/1999 | Rashak et al. | 84/725 |
| 6,078,006 | A | * | 6/2000 | Raisanen et al. | 84/733 |
| 6,111,184 | A | * | 8/2000 | Cloud et al. | 84/723 |
| 6,515,214 | B2 | | 2/2003 | Takabayashi | |
| 6,605,771 | B1 | * | 8/2003 | Baggs | 84/731 |
| 6,689,948 | B2 | | 2/2004 | Raisanen | |
| 6,852,402 | B2 | * | 2/2005 | Kirjavainen et al. | 428/305.5 |
| 7,166,794 | B2 | * | 1/2007 | Juszkiewicz et al. | 84/728 |
| 7,199,302 | B2 | * | 4/2007 | Raisanen | 84/723 |
| 7,408,109 | B1 | * | 8/2008 | Freitas | 84/723 |

FOREIGN PATENT DOCUMENTS

| | | | |
|---|---|---|---|
| ES | 291473 | B1 | 11/1963 |
| GB | 434421 | B1 | 8/1935 |
| GB | 454783 | B1 | 10/1936 |
| GB | 524619 | B1 | 8/1940 |

* cited by examiner

FIG. 1: METHOD AND APPARATUS FOR ELECTROSTATIC PICKUP FOR STRINGED MUSICAL INSTRUMENTS
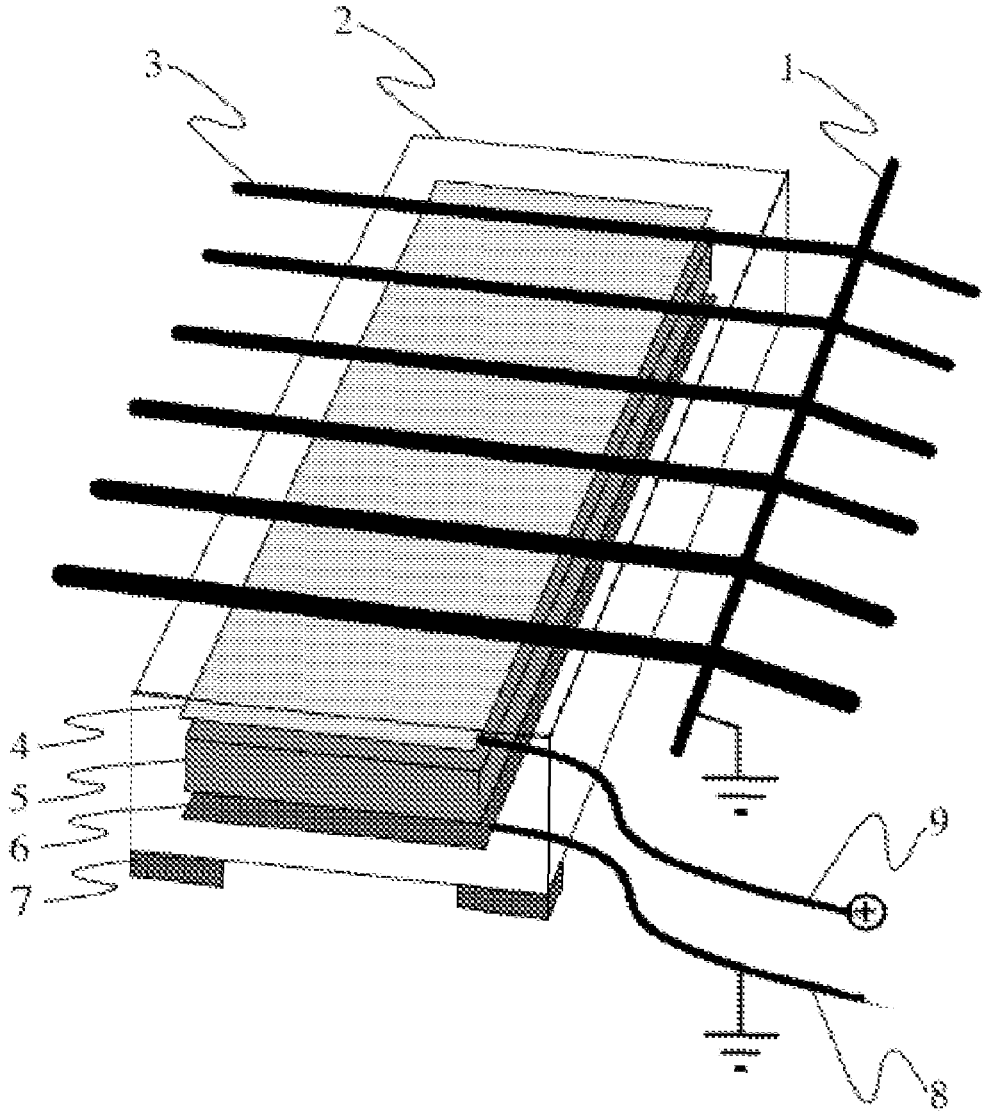

FIG. 2: SCHEMATICS OF ELECTROSTATIC PICKUP FOR STRINGED MUSICAL INSTRUMENTS
FIG 2A: 9 VDC SUPPLY
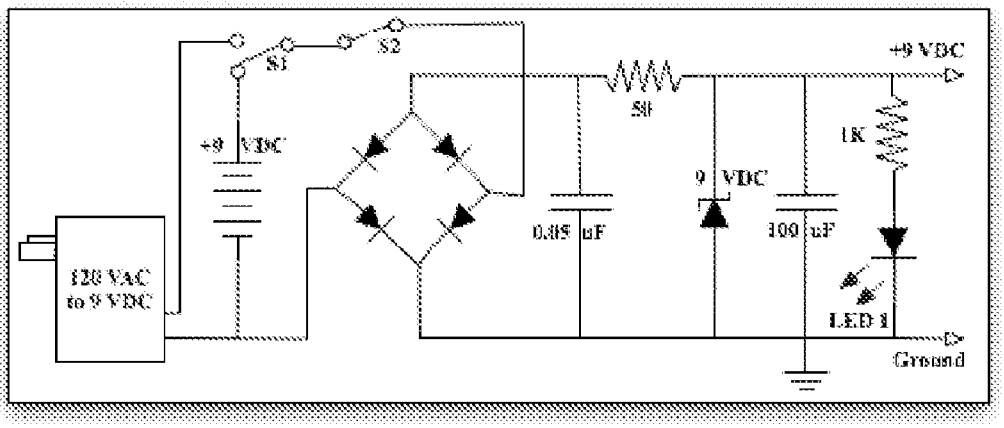
FIG 2B: 9 VDC TO 400 VDC CONVERTER
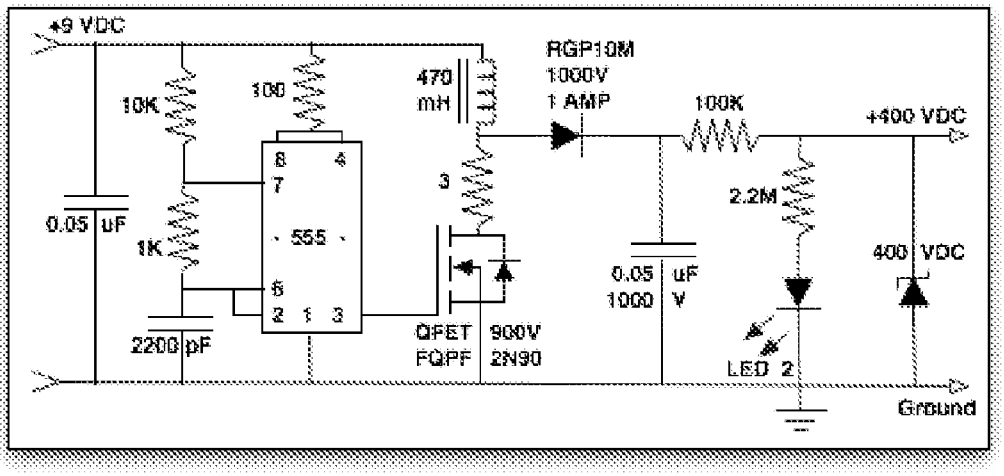
FIG 2C: ELECTROSTATIC PICKUP CIRCUIT
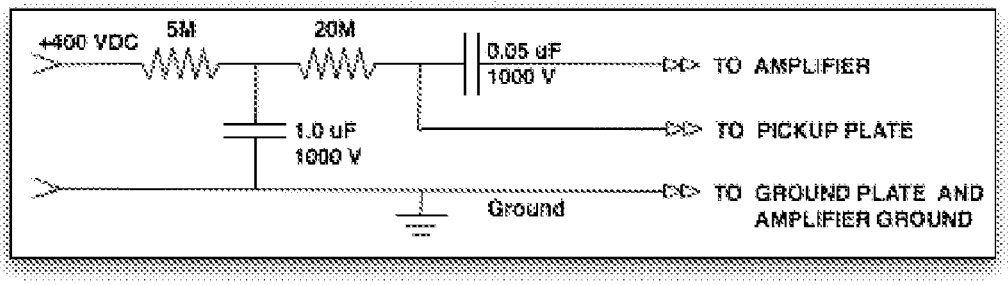

FIG. 3: TWO ELECTROSTATIC PICKUP PLATES WITH A COMMON GROUND PLATE
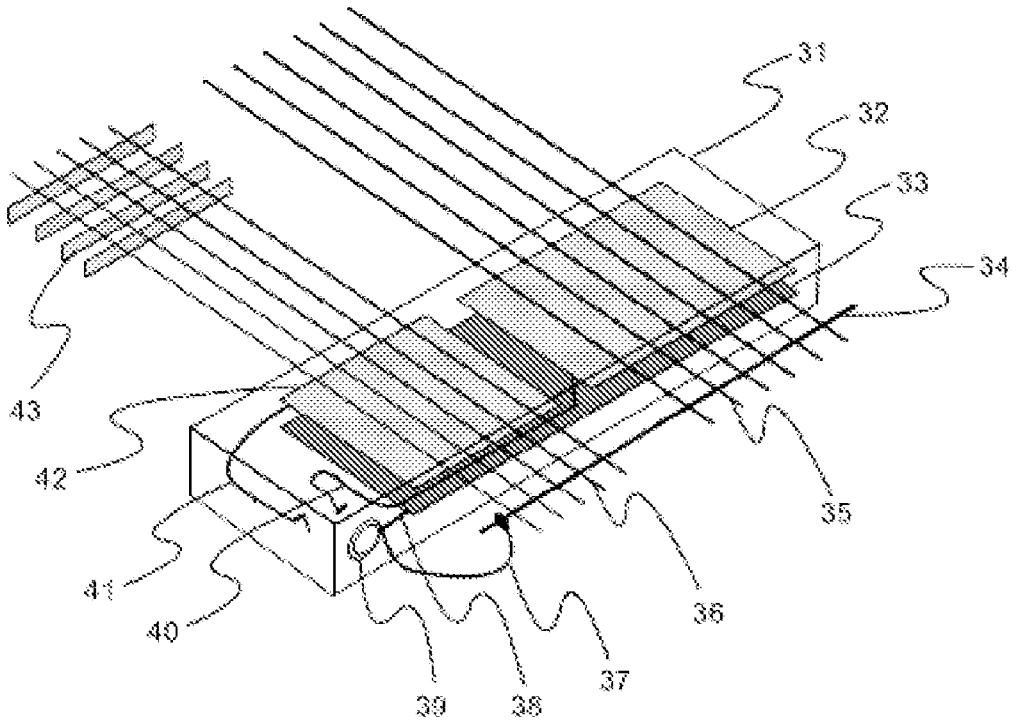

METHOD AND APPARATUS FOR ELECTROSTATIC PICKUP FOR STRINGED MUSICAL INSTRUMENTS

TECHNICAL FIELD AND INDUSTRIAL APPLICABILITY OF THE INVENTION

This invention relates to the method and apparatus for electrostatic pickup of sound for stringed musical instruments and their manufacture. The present invention addresses the unique requirements of acoustic stringed musical instruments with a portable, detachable, safe-to-handle, easy-to-use, low-noise, electrostatic pickup that captures the tone of the musical instrument, is usable with common musical sound systems, avoids acoustic feedback problems associated with air microphones in live settings, and is easy to manufacture using current common materials and practices.

BACKGROUND OF THE INVENTION

Those skilled in the art know the long history of development of microphones and pickups for musical instruments. Yet none have fully addressed the unique requirements for acoustic stringed musical instruments, such as guitars, dulcimers, harps, zithers, harpsichords, pianos, and other stringed musical instruments.

One means to pick up musical instrument sounds is by the use of microphones, such as an air microphone placed near or inside a musical instrument or a contact microphone affixed to a musical instrument. Difficulties in using microphones to amplify acoustic string instruments, particularly in live stage settings, have long been recognized by those skilled in the art. Considerable care must be taken in microphone selection and placement relative to the musical instrument in order to faithfully capture the instrument's tone. In addition, particularly for live performances, great care must be taken in amplifier adjustments and in the placement of loud speaker(s) in order to avoid acoustic feedback, caused when some resonant sound(s) generated by the loud speaker(s) feeds back to the microphone at a resonant frequency or frequencies, greatly reinforcing itself each time the sound is picked up by the microphone and amplified again on its way back to the loud speaker, causing the all-too-familiar feedback squeal, which can be damaging to equipment and painful to hear.

It has long been recognized by those skilled in the art that the current practice of electromagnetic pickup for vibrating tuned forks (e.g., U.S. Pat. No. 1,906,985, May 2, 1933, W. A. Marrison, Vibratory Frequency Standard) and for stringed musical instruments, for example, as on an electric guitar (e.g., U.S. Pat. Nos. 2,175,325, Oct. 10, 1939, H. S. Sunshine, Magnetic Pick-Up Device for Stringed Musical Instruments; 2,455,575, Dec. 7, 1948, C. L. Fender, et. al., Pickup Unit For Instruments; 2,573,254, Oct. 30, 1951, C. L. Fender, Combination Bridge and Pickup Assembly for String Instruments; 2,896,491, Jul. 28, 1959, S. E. Lover, Magnetic Pickup for Stringed Musical Instrument; 3,090,274, May 21, 1963, C. L. Fender, Electric Piano; 4,220,069, Sep. 2, 1980, L. C. Fender, Electromagnetic Pickup For Stringed Musical Instruments), does not capture the full tonality of the instrument. Indeed it is common practice for an electric guitar to have multiple sets of pickups, located at various distances between the bridge and fret board, in order to capture varying tonal characteristics. An electromagnetic pickup, generally consisting of a magnet and coil assembly, senses vibrations of ferro-metallic strings in the immediate vicinity of its magnetic coil, which typically encompasses only a very small portion of the total string length. While different electromagnetic pickups along the length of a vibrating string all sense the string's fundamental vibration (or note), each pickup emphasizes the string's harmonic vibrations present at that point on the string, causing each pickup along a string to produce different, often distinct, musical coloring or tone. Use of electromagnetic pickups necessitates the use of strings made with ferrous or ferrous-like alloys (such as nickel or phosphor bronze), to enable string vibrations to induce an electric current in the pickup coil, making electromagnetic pickups unsuitable for acoustic instruments using non-ferrous strings such as silver or nylon.

An alternative to the electromagnetic pickup is the piezoelectric element, often built-in to the bridge assembly and in contact with the musical instrument's strings (e.g., U.S. Pat. No. 2,222,057, Nov. 19, 1940, Hugo Benioff, Stringed Musical Instrument; U.S. Pat. No. 6,078,006, Jun. 20, 2000, H. Raisanen, et. al., Stringed Musical Instrument Transducer and Procedure for Its Fabrication; U.S. Pat. No. 6,515,214, Feb. 4, 2003, Yojiro Takabayashi, Pickup Unit Incorporated in Stringed Instrument for Converting Vibrations of String to Electric Signal in Good Fidelity). Although a single piezoelectric element may be used on, in, or near an instrument, such as a contact, tail, or bridge pickup, common practice is to use one (or more) piezoelectric element(s) under each string as it crosses the bridge assembly. In general this arrangement is preferred in order to better capture the instrument's tone. Due to the intricate relationships of string, piezoelectric element, and instrument bridge, piezoelectric elements are typically built into a musical instrument at time of manufacture. Electrical output of the piezoelectric elements is combined for use by an amplifier.

Another alternative to the electromagnetic pickup is the electrostatic pickup, which has a long history for reed organs (e.g., GB 434,421, Aug. 27, 1935, A. H. Midgley, Apparatus for Producing Sounds of a Musical Character; U.S. Pat. No. 2,015,014, Sep. 17, 1935, F. A. Hoschke, Musical Instrument; U.S. Pat. No. 2,318,936, May 11, 1943, R. C. Fisher, Multi-frequency Oscillator; U.S. Pat. No. 2,462,531, Feb. 22, 1949, B. Minshall, Musical Vibration Translating Unit; U.S. Pat. No. 2,542,611, Feb. 20, 1951, V. I. Zuck, Pickup for Electric Organs; U.S. Pat. No. 2,911,870, Nov. 10, 1959, H. G. Bauer, Organ Reed Support Assembly), organs with rotating disks (e.g., U.S. Pat. No. 1,785,915, Dec. 23, 1930, F. M. Robb, Sound Reproducing Instrument; BE 451,466, 31 Aug. 31, 1943, N. V. Philips, Gloeilampenfabrieken; U.S. Pat. No. 1,996,669, Apr. 2, 1935, L. E. A. Bourn, Electrical Musical Instrument; U.S. Pat. No. 2,001,708, May 21, 1935, W. F. Curtis, Production of Music; GB 454,783, Oct. 6, 1936, A. H. Midgley, Apparatus for Producing Sounds of a Musical Character; U.S. Pat. No. 2,176,525, Oct. 17, 1939, F. A. Firestone, Electrical Musical Instrument; U.S. Pat. No. 2,214,764, Sep. 17, 1940, L. Hammond, Electrical Musical Instrument; U.S. Pat. No. 2,770,995, Nov. 20, 1956, G. R. Stibitz, Wave Form Generator; U.S. Pat. No. 2,921,494, Jan. 19, 1960, D. J. Leslie, Electrostatic Musical Tone Generator System; U.S. Pat. No. 2,952,179, Sep. 13, 1960, C. W. Andersen, Electronic Piano; ES 291,473, Nov. 16, 1963, J. A. Dereux, Dispositif de Silence pour Orgue Electro-Statique; U.S. Pat. No. 3,621,106, Nov. 16, 1971, J. M. Irastorzo, Electronic Tone Generator; FR 2,187,170, Jan. 11, 1974, Rameau (SA), Piano Electronique; U.S. Pat. No. 3,259,683, Jul. 5, 1966, D. J. Tomcik, Electric Organ), pianos with vibrating rods, bars, or strings, (e.g., U.S. Pat. No. 1,915,859, Jun. 27, 1933, B. F. Miessner, et. al., Method and Apparatus for the Production of Music; U.S. Pat. No. 1,952,630, Mar. 27, 1934, N. A. Palmgren, Musical Instrument; U.S. Pat. No. 2,986,963, Jun. 6, 1961, E. M. Jones, Electropiano, U.S. Pat. No. 3,139,476, Jun. 30, 1964, O. J. Alvarez, Elecrical Musical String Instrument; U.S. Pat. No. 3,334,174, Aug. 1, 1967, T. Shiga, et. al., Electronic Musical Instrument), carillons (e.g., U.S. Pat. No. 2,261,346, Nov. 4, 1941, G. W. Demuth, Electric Carillon; U.S. Pat. No. 2,284,911, Jun. 2, 1941, L. A. Maas, Musical Instrument; U.S. Pat. No. 2,582,441, Jan. 15, 1952, J. T. Kunz, Electric Bell Tone Generator Mechanism), accordions (e.g., U.S. Pat. No. 2,368,842, Feb. 6, 1945, Y. K. Kealoha, Musical Instrument), music boxes (e.g., U.S. Pat. No. 2,018,924, Oct. 29, 1935, R. H. Ranger, Apparatus for Producing Musical Tones); harmonica (e.g., U.S. Pat. No. 3,322,875, May 30, 1967, J. B. Roll, et. al., Harmonica Electronic Amplification), electrostatic contact or internal microphones (e.g., U.S. Pat. No. 2,228,881, Jan. 14, 1941, M. F. Le Clair, Music Producing Apparatus; U.S. Pat. No. 4,230,013, Mar. 21, 1979, F. L. Wellings, Electro-Acoustic Transducer; U.S. Pat. No. 4,495,641, Jul. 11, 1983, R. Vernino, Microphone Pickup for Musical Instruments; U.S. Pat. No. 4,995,293, Feb. 26, 1991, P. N. Anderson, Acoustic Instrument with Internally Positioned Microphone Means for Receiving Acoustical Vibrations), and phonograph pickups (e.g., GB 524,619, Aug. 12, 1940, Steatit-Magnesia A G, Improvements in and Relating to Electrostatic Recorders and Pick-Ups; U.S. Pat. No. 2,623,996, Dec. 30, 1952, J. W. Gray, Capacity Motion Responsive Device). However, the development of electrostatic pickups largely neglected the unique requirements for acoustic stringed musical instruments and has received little attention in recent years.

In 1949, Julius W. Gebhardt (near Poukeespie, N.Y.; now deceased; personal communications) experimented with electrostatic pickups for acoustic stringed musical instrument. Based on his reading at the time of some of the previously cited early patents for capacitive pickups in pianos and reed organs, he devised a novel approach to overcome many of the aforementioned limitations. Instead of using reeds or rotating disks, Gebhardt experimented with using one or more musical instrument strings for one side of a capacitive electrostatic pickup and a charged metal plate as the other side. He charged the metal plate with 240 volts direct current (DC), using electricity from the high-voltage direct-current power supply commonly available in vacuum-tube amplifiers, with a DC blocking capacitor to recover the signal created by string vibrations. During the following years, he installed his system on several concert zithers for his own use without applying for a patent on his pickup system.

The concert zithers on which Mr. Gebhardt installed his pickups had 5 fret board strings and 30 or more accompaniment strings, with one pickup plate under each group of strings; both pickup plates were attached to the instrument with standoffs and screws. To prevent unwanted contact with the plates, a pick guard was placed above the fret-board pickup plate and strings; the pickup plate for the accompaniment strings was placed under the strings away from the area being plucked. The pick guard above the fret-board strings limited the area in which the pick could be used, somewhat altering the position of the player's hand.

In spite of the pick guard and paint covering the plates, occasional accidental contact of a player's fingers or pick with a pickup plate would impart an unpleasant electrical shock to the player (akin to touching a doorknob after walking on a carpet during low-humidity winter weather). In addition, sudden uncontrolled electrostatic discharge created sudden intense crackling noise on the output signal of the DC blocking capacitor, sending potentially damaging noise pulses to connected equipment and speakers, which listeners would experience as loud, sharp, crackling noise.

There are two other issues with the prior art of electrostatic capacitive pickups for stringed instruments, including Gebhardt's embodiment. First, mounting the pickup plate(s) required attaching each plate with at least three screws penetrating into the body or structure of the instrument. The invasive nature of the screws embedded in the body of the musical instrument, along with the rigid attachment of metal plate(s), offered the distinct possibility of altering the musical tonal properties of the acoustic instrument to which they were attached. In at least one case, some players felt that the long pickup plate on a zither under the accompaniment strings physically muted the sound of an instrument, weakening its tone. The permanent nature of the pickup plate mounting made their removal difficult, discouraging unimpaired use of an instrument either with or without its pickup(s) at player discretion.

Another issue is the need for a high-voltage electric charge for the pickup plate, typically over 240 volts DC. Gebhardt used a wire to a vacuum tube amplifier's plate power supply. While simple and effective, it required a tube amplifier and modification to the amplifier by a qualified service person. For portable use with an unaltered amplifier, a 240-volt battery, made specifically for portable tube radios, could be used. However, as transistor radios became popular, portable tube radios and their high-voltage batteries became harder to obtain, eventually becoming obsolete.

The present invention as described hereinbelow is directed at improvements to the prior art, exemplified by Gebhardt as related above, of electrostatic pickup systems for stringed musical instruments; specifically, the present invention is safe to handle, preventing shock hazard to player and attached electronic equipment, allows pickup assemblies to be easily attached and removed without invasive alteration of the instrument, blocks stray electrical hum and noise, operates from a small portable battery-powered, or plug-in, power supply, may be used with existing music sound systems, captures the tone of the musical instrument, and is simple to manufacture with common materials and practices.

SUMMARY OF THE INVENTION

The present invention relates to an electrostatic pickup system for stringed musical instruments, overcoming limitations of the aforementioned pickup methods for stringed musical instruments and improving on the prior art of electrostatic pickups for stringed musical instruments. In preferred embodiments, the electrostatic pickup system:

(i) Prevents sudden static discharge if a pickup assembly is accidentally touched by a player finger, pick, plectrum, hammer, bow, or other object (ii) Shields against undesired electrical noise by using an internal ground plate (iii) Avoids mechanically invasive pickup mounting mechanisms so modifications to the musical instrument are not required, thereby preserving acoustical properties of the instrument and also facilitating attachment and removal of pickup(s) from the instrument; however, permanent attachment, if desired, is not ruled out, particularly for built-in pickup(s):

(iv) Captures the tone of an acoustic stringed musical instrument, enhanced by use of non-invasive pickup mounts (v) May be used with or in place of electromagnetic pickups on traditional electric instruments, such as on an electric guitar (vi) Is powered by common battery or common home electrical power, with no need to alter any attached ancillary electronic equipment, such as an amplifier (vii) Uses readily available parts and can be constructed with common practices These advantages are in addition to the advantages embodied in Gebhardt's prior art of electrostatic pickups for stringed musical instruments, including:

(i) Use with strings made with traditional materials, including both ferrous and non-ferrous materials, for example, steel, brass, silver, nylon, gut, etc.

(ii) Combine a plurality of strings together, such as a group of treble strings, bass strings, fret board strings, or accompaniment strings (iii) Provide one or more electrical signal outputs (iv) Capture the tone of a stringed instrument The electrostatic pickup of this invention uses a metallic plate placed in proximity to the strings of an instrument. The plate forms one side of an electrical capacitor and the strings function as the other side of the capacitor. The vast majority of prior art for electrostatic pickups, see citations above, other than the Gebhardt embodiment, rely on a vibrating reed, rod, or bar or rotary disk as a tone generator, whereas the present invention, building on Gebhardt's embodiment, uses the vibrating strings of an existing acoustic musical instrument as the tone source.

In the electrostatic pickup of this invention, an electrical potential charge is placed and maintained on the pickup plate. The strings are maintained at electrical ground potential, so that they may be plucked by the player (or other mechanical means) and may be stopped (shortened), for example by placing a finger on a string over a fret board or fingerboard. When one or more strings vibrates, the distance changes between the two sides of the capacitor formed by the plate and strings, generating a change in the electrical potential of the plate in accordance with well-known principles of electrical capacitance (see below for more on the electrical theory of operation of electrostatic pickup for stringed instruments). A coupling capacitor attached to the pickup plate blocks the direct current charge on the plate but passes the alternating current signal generated by string vibrations. The resultant electrical signal may then be passed on to an amplifier for use.

An innovation of the electrostatic pickup assembly of this invention is a second plate placed inside the pickup assembly behind the pickup plate on the side away from the strings. This second plate is at electrical ground potential and shields the back of the pickup plate from any stray electrical fields, including any that may be picked up by the player's body acting as an antenna. The strings, also at ground potential, shield the front or string side of the pickup plate. This arrangement places the pickup plate between the grounded strings and the grounded back plate. This is very effective in eliminating unwanted hum and noise in electrically noisy environments, such as in the proximity of electronic digital devices like electronic keyboards, electric musical instruments, audio equipment, personal computers, displays, printers, modems, power supplies, etc. In addition, all wiring and connectors are electrically shielded, as is common practice for instrument pickups.

Another innovation is that the pickup and ground plates are enclosed in and separated by material(s) with a high dielectric constant, such as wood or plastic. The dielectric covering must be thick enough to prevent sudden electrostatic discharge when a player or object in any way touches the pickup plate assembly, either accidentally or intentionally. Any sudden uncontrolled discharge, caused by player contact with an unprotected pickup plate, may impart an unpleasant electrical shock to the player (akin to touching a doorknob after walking on a carpet during low-humidity winter weather). In addition, the uncontrolled electrostatic discharge may impose unwanted crackling noise on the output signal of the coupling capacitor, sending potentially damaging noise signals to connected audio equipment and speakers, which can be most unpleasant to hear. Simply painting the pickup plate is not sufficient to stop the crackling noise if the pickup plate is contacted; however, enclosing the plate with a thin layer of suitable dielectric material is an effective and reliable preventative. The dielectric covering increases the total effective air gap between pickup plate and strings (proportional to the material's dielectric constant and thickness), which helps reduce any variation in string height relative to the pickup plate. Similarly, the high dielectric material between the pickup plate and the ground plate on the back is equivalent to a much larger air gap between the pickup plate and the ground plate, which greatly reduces attenuation of the signal generated on the pickup plate by vibrating strings.

One electrostatic pickup assembly may be used with one or more strings and one or more pickup assemblies may be electrically connected, so a stringed instrument may have more than one pickup. One preferred arrangement is to use one pickup for treble or fret board strings and a second pickup for accompaniment or bass strings. The signal output from the coupling capacitor for each pickup assembly can be sent to its own amplifier, for individual control and amplification. Depending on the geometry of the strings on the musical instrument, it may be possible to use a single backing ground plate for more than one pickup plate. Another arrangement for electrostatic pickups mimics the placement of multiple pickups on an electric guitar to emphasize different tonal characteristics at different positions on the strings. However, by using broad plates (typically in the range of 5% to 10% of the free string length), vibrations from a broader section of the strings may be picked up, ensuring the capture of a broader range of string harmonics in the output signal. Thus for an acoustic stringed instrument, the instrument's acoustic tone may be captured by a broad electrostatic pickup plate for each desired group of strings. Electrostatic pickup assemblies are mounted in close proximity to the strings, just far enough away to avoid contact with vibrating strings, usually in the range of 3 to 10 string diameters.

Another innovation of the preferred embodiment of electrostatic pickup assemblies for stringed musical instruments described in this invention focuses on their use and mounting mechanism; electrostatic pickups may be used on a musical instrument without the need for any structural modifications to the instrument. Electrostatic pickups may rest on instruments with soft protective feet and be held in position with soft foam fittings, padded brackets, soft or elastic straps, etc. Particularly for acoustic stringed musical instruments, the ability to use a pickup without physically altering the musical instrument preserves the instrument's valuable and unique acoustical properties and character; furthermore, the instrument may be played with or without the pickup, as desired. In other words, the pickup plate may be placed on the instrument without requiring any physical or structural modifications to the instrument, so the instrument's acoustical qualities remain unchanged. Invasive holes, bolts, screws, nails, brackets, fittings, attachments, glue, etc., are not required.

Mounting methods for electrostatic pickups of this invention are quite flexible, as discussed in the following examples. For musical instruments with player-plucked strings, such as guitars, mandolins, dulcimers, and zithers, the pickup assembly may be mounted under the strings, that is, under the side of the strings being plucked; on guitars, the pickup may be mounted across the sound hole and may be held in place by the rim of the sound hole; on a harp where strings are plucked on both sides, the pickup may be mounted away from the player's fingers, near one end of the vibrating portions of the strings; on a harpsichord, clavichord, or piano, where keys activate string vibration, the pickup may be mounted either under the strings (ideal for built-in pickups) or above the strings (ideal for portable, removable pickups).

The physics of sound and vibrating strings of musical instruments contributes positively to the psycho-acoustic responsiveness of electrostatic pickups as described in this invention. This effect is described in the following event chain:

(i) Low pitched musical notes require heavier, larger-diameter strings (ii) Larger-diameter vibrating strings, effectively one side of the plate-string capacitor, generate a larger signal on the pickup plate, compared to a thinner string with a higher frequency (iii) Particularly at lower listening levels, human hearing and loud speakers both require increased bass amplification in order for low pitches (notes) to be perceived at a constant flat frequency response relative to higher pitches (hence the common practice of bass boost or loudness controls in audio equipment).

In electrostatic pickups for string musical instruments, bass boost is inherently provided by the larger diameter of bass strings, based on the physical properties of the vibrating strings that drive the acoustic signature of the instrument. Furthermore, the intimate contact of the ends of the string with the instrument structure and body, as well as the in-air acoustic coupling of instrument and strings, ensures that string harmonic tones are transmitted to the instrument and that the harmonics augmented (or damped) by the instrument are, in turn, feed back to the strings, augmenting (or damping) various string dynamics, which contribute to the tone picked up by electrostatic pickups.

The electrical theory of operation of electrostatic pickup for stringed instruments closely resembles that of the condenser microphone (see U.S. Pat. No. 1,758,777, Frederick C. Barton, May 13, 1930, Condenser Microphone), also known as a capacitor microphone. In terms of theory of operation, the condenser microphone's vibrating diaphragm has been replaced by vibrating strings in the design of the electrostatic pickup for stringed musical instruments. In both cases, the theory of operation is governed by the well-known capacitance equation:

$$Q=C\cdot V$$

where Q is charge measured in coulombs, C is capacitance in farads, and V is the electrical potential in volts between the plates. For a given set of plates held at constant electric charge, the plate capacitance varies inversely in proportion to the distance between the plates. Halving the distance between the plates thus doubles the capacitance, while doubling the distance between the plates halves the capacitance. As the distance between the plates changes, the charge on the plate is held nearly constant, but the effective voltage between the plates varies in proportion to plate movement. For the electrostatic pickup for stringed musical instruments, the vibrating string(s) form the moving vibrating side of the capacitor.

A variation on the condenser microphone described above is the newer electret microphone, also known as the electret condenser microphone (U.S. Pat. No. 3,118,022, G. M. Sessler and J. E. West, Jan. 14, 1964, "Electroacoustic Transducer"), which may also be used as a contact microphone (e.g., U.S. Pat. No. 6,689,948, Feb. 8, 2004, H. E. Raisanen, Transducer and Method for Forming a Transducer; U.S. Pat. No. 6,852,402, Feb. 8, 2005, Kirjavainen, et. al., Dielectric Cellular Electret Film and Procedure for Its Manufacture). The electret microphone contains a diaphragm consisting of a thin polymer film with a permanent electrical charge imparted on one side in close proximity to a metal plate, forming a permanently charged capacitor. Diaphragm movement generates a small electrical signal between the diaphragm and plate; typically, a built-in preamplifier, such as a low-power FET, boosts the small electrical signal before being fed to an amplifier. Since the charge on the polymer film is permanent, there is no need to supply any voltage charge to one side of the electret microphone's capacitor. However, some electrical power is required for any built-in preamplifier.

BRIEF DESCRIPTION OF THE DRAWINGS

The principal features of the present invention become more apparent and become easier to understand by following the illustrative descriptions of preferred embodiments of an apparatus for electrostatic pickup for stringed musical instruments in accordance with the present invention as shown in FIGS. 1, 2, and 3.

FIG. 1 is a three-dimensional drawing of an electrostatic pickup assembly of the present invention, not to scale, illustrating the interior components of an electrostatic pickup assembly.

FIG. 2 provides a preferred embodiment of an electronic schematic of an electrostatic pickup system of the present invention; the schematic comprises three sections, which are connected in the order of A to B to C.

FIG. 2A: 9 VDC SUPPLY is the low-voltage part of the power supply section which may be powered by a common 9-volt battery (or a battery pack of 6 AA batteries for longer duration) or by a common plug-in wall wart transformer with 9-volt direct current output. LED 1 indicates when power is present.

FIG. 2B: 9 VDC TO 400 VDC CONVERTER is powered on the left side by the output of the low-voltage supply of FIG. 2A; the circuit boosts the 9 VDC input to 400 VDC for the output. LED 2 in FIG. 2B indicates when high-voltage is present.

FIG. 2C: ELECTROSTATIC PICKUP CIRCUIT is connected on the left to the high-voltage output of FIG. 2B. FIG. 2C shows how the pickup plate and the ground plate of the electrostatic pickup assembly are connected to the high-voltage power supply and how the alternating-current output signal generated by vibrating strings is taken from the pickup plate and fed to an amplifier for subsequent use.

FIG. 3: TWO ELECTROSTATIC PICKUP PLATES WITH A COMMON GROUND PLATE shows a pickup assembly containing two pickup plates working with one single ground plate in a common assembly. The illustration shows the two pickup plates connected to the two signal leads of a stereo output jack, with the ground plate attached to the jack's ground pin; the ground pin is also connected to a ground wire that clips to the strings' bridge wire to provide electrostatic ground for the strings. As shown, one pickup plate collects signals from the instrument's fret board strings and the other pickup plate collects signals from the accompaniment strings. Each pickup plate is connected to its own electrostatic pickup circuit (FIG. 2C), which may connect to a common high-voltage supply (FIG. 2B) driven by a single low-voltage supply (FIG. 2A).

DETAILED DESCRIPTIONS OF PREFERRED EMBODIMENTS

Refer to the drawings, in which numbers refer to indicated elements and electronic components are depicted using standard electronic symbols with stated component values. All resistance values are in ohms.

FIG. 1 shows an electrostatic pickup assembly pointed to by number 2. The illustration is not to scale, but illustrates the relative positions of various components. The outer surfaces of pickup assembly 2 consist of a high dielectric material such as wood or plastic. The pickup is placed in proximity to one or more musical instrument strings 3, strung over a bridge 1. In this illustration the bridge 1 incorporates a metal wire that touches the strings 3, which is used to keep the strings at electrostatic ground potential. In practice, other means may be used to provide the strings with contact to an electric ground. Inside the pickup assembly 2 are two metal plates, the pickup plate 4 and a ground plate 6, which are separated by material 5 with a high dielectric constant. A wire 9 supplies high voltage DC charge to pickup plate 4; another wire 8 connects the ground plate 6. At the ends of the pickup assembly 2 are soft feet or bumpers 7, which rest on the instrument.

FIG. 2, in three parts, shows the low-voltage power supply (FIG. 2A), the high-voltage power supply (FIG. 2B) and the electrostatic pickup circuit (FIG. 2C). Component values are shown for a preferred embodiment.

FIG. 2A shows that the low-voltage power supply may be fed from either a common 9-volt battery or a common plug-in (for standard home power outlet) wall wart transformer with 9-volt direct-current output. Switch S1, which may be activated by the insertion of a low-voltage connector on a wall-wart, determines whether the battery or wall wart is in use. Switch S2 serves as an on/off power switch. The bridge of four diodes protects against reverse polarity connection of battery or wall-wart. The capacitors and 50-ohm resister filter the direct current and provide current limiting, while the 9-volt zener diode provides voltage regulation. LED 1, protected by a 1K-ohm current-limiting resistor, indicates the presence of low-voltage power.

FIG. 2B shows a converter to boost the 9 VDC from FIG. 2A to 400 VDC for use in the circuit in FIG. 3C, which connects to an electrostatic pickup assembly. In FIG. 2B, the 555 integrated circuit timer chip is set to run at about 30 K Hz by the 10K-ohm and 1K-ohm timing resistors and 2200-pF timing capacitor. Use of an ultrasonic frequency helps avoid audible noise. The output of the 555 timer is fed to the QFET transistor that charges the 470-mH inductor via a current limiting 3-ohm resistor. The inductor discharges each time the 555 timer output falls to zero; the inductor's rapidly collapsing magnetic field generates a high-voltage spike that is rectified by the 1000-volt 1-amp fast-recovery diode, filtered by the 1000-volt 0.05-uF capacitor. The 100K-ohm resistor limits current to the 400-volt zener diode that regulates output voltage. LED 2, protected by a current limiting 2.2M-ohm resistor, indicates the presence of high-voltage output.

FIG. 2C shows how the high voltage output from FIG. 2B connects to an electrostatic pickup assembly consisting of a pickup plate and a ground plate. FIG. 2C also shows how the signal is taken off the pickup plate and fed to an amplifier (not shown) for subsequent use. In FIG. 2C the high voltage input is used to charge the 1.0-uF storage capacitor via a 5M-ohm resister. A 20M-ohm resistor draws from the storage capacitor to charge the pickup plate and holds the plate charge constant. The 0.05-uF 1000-volt capacitor blocks direct current while passing the alternating-current signal generated on the pickup plate by the vibrating strings; the resultant signal may then be passed on to an amplifier for subsequent use.

Note that FIG. 2A, FIG. 2B, and FIG. 2C all share a common ground, which is connected to the ground plate in the electrostatic pickup assembly and is connected to the ground of the amplifier receiving the output signal.

FIG. 3 shows an electrostatic pickup assembly 31 that has two pickup plates 32 and 42 above a common ground plate 33. Indeed, a single ground plate may be used with a plurality of pickup plates, as desired. It is also possible for a plurality of pickup plates to be electrically connected together and to share one or more electrically connected ground plates. Although the two pickup plates 32 and 42 in FIG. 3 are in one assembly 31, they are connected independently by wires 40 and 41 to individual contacts of output jack 39 to provide two output signals, such as for stereo output. One pickup plate 42 is positioned under treble or fret-board 43 strings 36 for one channel and the other pickup plate 32 is positioned under the remaining strings 35, including bass strings, for the other channel. Each pickup plate connects to its own electrostatic pickup circuit in order to pass its own signal on to its own amplifier channel. The ground ring of the output connector 39 connects by wire 38 to the ground plate 33 and by wire and clip 37 to the bridge wire 34. The ground plate 33 is separated from the pickup plates 32 and 42 by a high dielectric material such as wood or plastic. The entire electrostatic pickup assembly 31 is encased or covered by a high dielectric material such as wood or plastic.

Although preferred embodiments have been shown and described for the present invention, it will be understood by those skilled in the art that various modifications in form and detail may be made therein without departing from the scope and spirit of the invention. Accordingly, modifications to the preferred embodiments will be readily apparent to those skilled in the art, and the generic principles defined herein may be applied to other embodiments, instruments, or applications without departing from the scope and spirit of the invention.

What is claimed is:

1. An integrated self-contained electrostatic pickup system to capture sound of stringed musical instruments comprising:

(a) a capacitive pickup plate as a stationary electrode positioned between a stationary ground plate and electrically grounded instrument string(s) as a non-stationary electrode wherein the pickup plate is shielded on both front and rear sides from stray electrostatic fields, reducing hum and noise;

(b) high-dielectric material between the pickup plate and ground plate to minimize damping effects of the ground plate upon the signal generated by vibrating string(s);

(c) sufficient width of the pickup plate along the axial length of the string(s) to capture a range of string harmonics of the musical instrument;

(d) a low-voltage electrical supply;

(e) a means of boosting low voltage to low-current filtered high voltage for pickup plate bias;

(f) a means to apply high voltage to the pickup plate and isolate alternating-current signals generated by vibrating string(s) for connection to an amplifier or other electronic equipment.

2. An integrated self-contained electrostatic pickup system to capture sound of stringed musical instruments according to claim 1 further comprising sufficient dielectric material covering the pickup plate to prevent electrostatic discharge when touched by any grounded object.

3. An integrated self-contained electrostatic pickup system to capture sound of stringed musical instruments according to claim 1 further comprising fittings for mounting the pickup temporarily (non-invasively).

4. An integrated self-contained electrostatic pickup system to capture sound of stringed musical instruments according to claim 1 further comprising fittings for mounting the pickup permanently (invasively).

5. An integrated self-contained electrostatic pickup system to capture sound of stringed musical instruments according to claim 1, wherein said electrostatic pickup system is independent of external high-voltage power supply, permitting use with existing music sound amplification systems.

* * * * *